United States Patent [19]

Baker

[11] Patent Number: 4,614,390

[45] Date of Patent: Sep. 30, 1986

[54] LEAD SEALING ASSEMBLY

[75] Inventor: Robert W. Baker, Harrow, England

[73] Assignee: AMP Incorporated, Harrisburg, Pa.

[21] Appl. No.: 735,427

[22] Filed: May 17, 1985

[30] Foreign Application Priority Data

Dec. 12, 1984 [GB] United Kingdom ..... 8431301

[51] Int. Cl.[4] ..... H01R 11/00

[52] U.S. Cl. ..... 339/61 R; 339/94 C; 339/59 R

[58] Field of Search ..... 339/59 R, 59 M, 60 R, 339/60 C, 60 M, 61 R, 61 C, 61 M, 75 R, 75 M, 91 R, 94 R, 94 C, 94 M

[56] References Cited

U.S. PATENT DOCUMENTS 3,675,184 7/1972 Vetter ..... 339/103 B
4,114,974 9/1978 Lawrence ..... 339/94 C

FOREIGN PATENT DOCUMENTS 0033031 5/1981 European Pat. Off. .
1051493 12/1966 United Kingdom .

*Primary Examiner*—Gil Weidenfeld
*Assistant Examiner*—Paula A. Austin
*Attorney, Agent, or Firm*—Thomas G. Terrell

[57] ABSTRACT

An insulating housing has therein a sealing ring having a central peripheral groove. An electrical terminal connected to an electrical lead can be inserted into the housing through a bore in a cap in the housing and through sealing. The cap can then be driven inwardly of the housing to compress the sealing ring and thus to collapse it, to cause the sealing ring to form a seal between the housing and the lead, the cap being retained in its inward position by the engagement of lugs on the cap in windows in the housing.

5 Claims, 6 Drawing Figures

Fig. 5
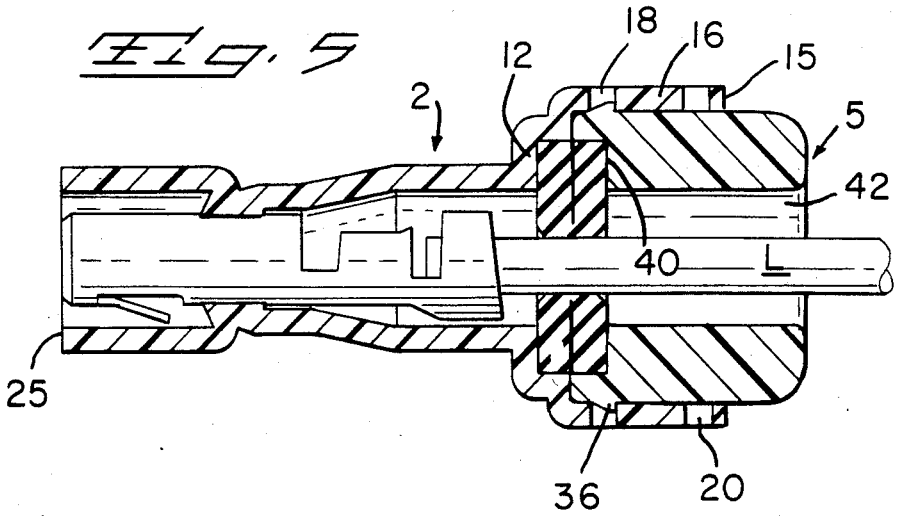
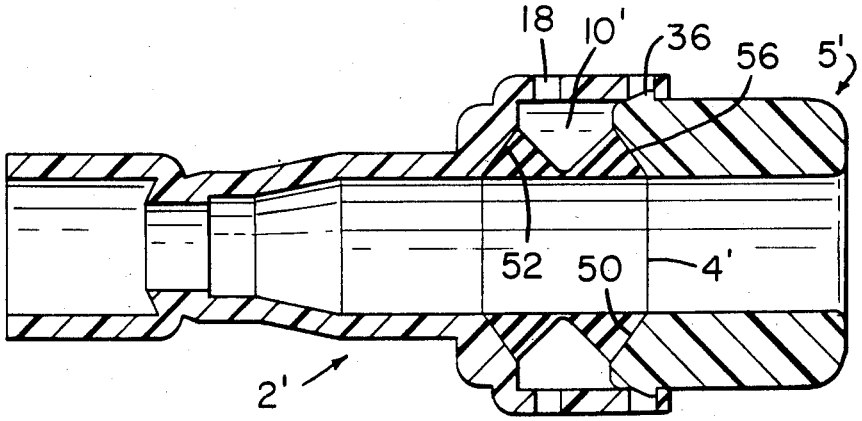
Fig. 6

LEAD SEALING ASSEMBLY

This invention relates to a lead sealing assembly, particularly, but not exclusively, for sealing a housing containing an electrical terminal connected to an electrical lead and providing a seal between the lead and the housing.

Especially in the automotive industry, there is a continuing demand for electrical connectors that are sealed against the ingress of moisture, where the connector is likely to be exposed to the weather.

Although bung seals are commonly used for preventing the ingress of moisture between the housing of an electrical connector and a lead extending therefrom, the loading of the housing with a terminal connected to a lead is complicated by the necessity for threading the lead through the bung seal before connecting the terminal to the lead end, unless a specialized tool is employed, and the threading operation is in any event difficult to carry out rapidly because unless the bung seal offers substantial resistance to the treading of the lead therethrough, effective sealing between the lead and the housing is unlikely to be achieved.

In order to avoid this disadvantage the invention provides an electrical lead sealing assembly comprising a housing for receiving an electrical lead, an elastomeric, annular sealing member in the housing, and through which the lead can freely be passed, and an annular cap through which the lead can also freely be passed. The cap can be moved from an outer position in the housing into a home position in the housing axially to compress the sealing member. The sealing member is recessed so that when it is compressed by the cap it is thereby collapsed so as to form a seal between the lead and the housing. Means are provided for retaining the cap in its home position.

The difficulty of passing the lead through the sealing member is accordingly avoided, since the sealing member need not tightly engage the lead prior to the cap being moved to its home position.

The assembly may be used simply for providing a seal about a lead, or the sealing member may be dimensioned not only freely to receive a lead, but also freely to receive a terminal connected to the lead, whereby the housing can be loaded, without the use of tooling, with a terminal which has been applied to the lead by means of an automatic machine for cutting lead lengths from a continuous supply of wire and applying terminals to the ends of such lead lengths.

The sealing member is preferably of circular cross-section, having a substantially V-shaped recess extending about the entire circumference of the sealing member, centrally thereof.

In order to enhance the compressibility of the sealing member and thus its expansion within the cavity, so as to provide a tight seal, the depth of the recess is preferably such that the wall of the sealing member, at the base of the recess, is as thin as possible, being, for example, in the form of a membrane connecting two major portions of the sealing member.

In order to assist the production of the sealed connector, the cap is preferably arranged to be releasably retained in its outer position in the cavity in which it does not compress the seal, being drivable from such position into its home position. The housing, the sealing member, and the cap may thus form a single unit whereby all that needs to be done to complete the sealed connector is to insert the terminal into the cavity and then to drive home the cap.

For a better understanding of the invention and to show how it may be carried into effect, reference will now be made by way of example to the accompanying drawings, in which:

FIG. 5 is a similar view to that of FIG. 4 but showing the assembly when the cap has been driven home to provide a seal between the lead and the housing; and FIG. 6 is a similar view to that of FIG. 2 but illustrating a modification of the assembly.

Figure 1:
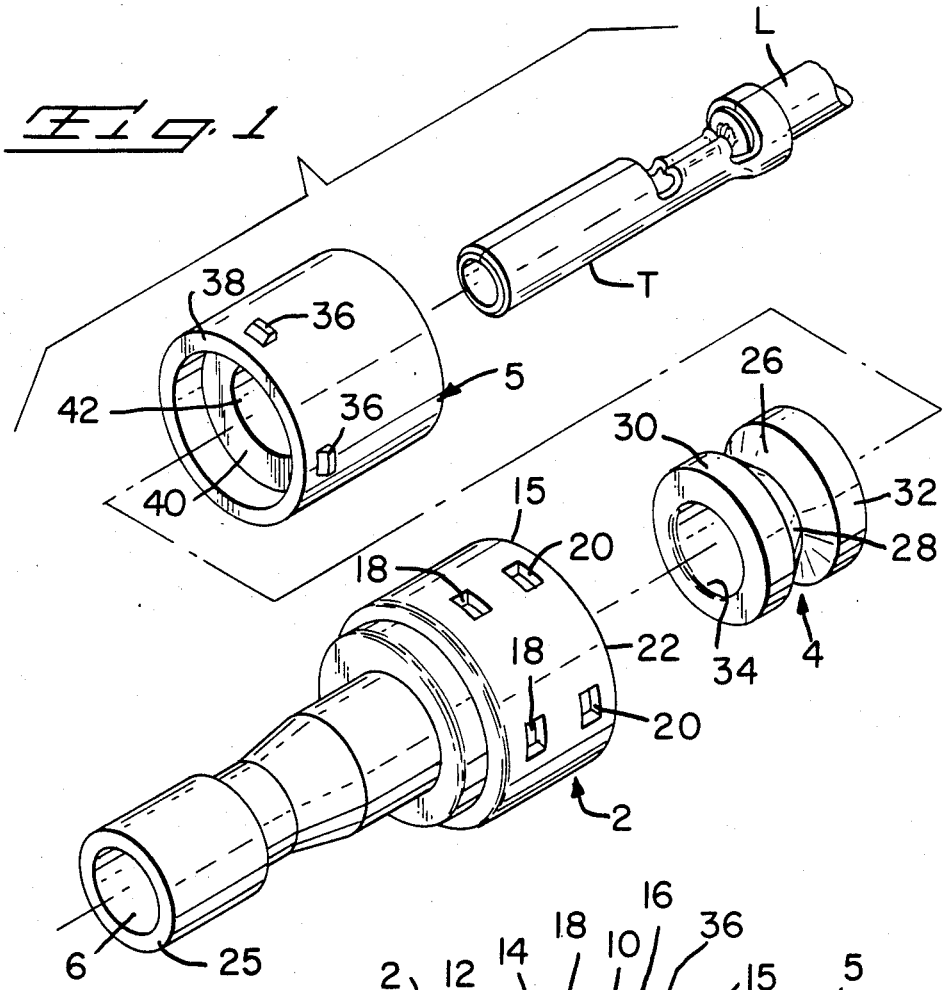
FIG. 1 is an exploded perspective view of an electrical lead sealing assembly in association with an electrical terminal that has been crimped to an end of lead, the assembly comprising an insulating housing, a sealing member, and a cap.

The assembly comprises a circular cross section insulating housing 2, and elastomeric, annular sealing member in the form of a sealing ring 4, which is also of circular cross section, and a circular cross-section, annular cap 5. The cap may be of the same material as the housing, or may be of metal. The sealing ring 5 is made of an elastomeric material. Both the sealing ring 4 and the cap 5 may be made of a synthetic rubber-like material, but the flexibility of the cap 5 must be substantially less than that of the sealing ring 4.

The housing 2 defines a circular cross-section cavity 6 having a first portion 8, and a second portion 10 of substantially greater cross-sectional area than the portion 8. The housing 2 defines, in the portion 8, a first annular shoulder 12, and a second annular shoulder 14 extending normally of the shoulder 12. Between the shoulder 14 and the right hand (as seen in FIGS. 2 to 5) end 15 of the housing, the housing has a cylindrical wall 16 formed with windows 18 and 20, the windows 18 which are all on the same circumference are proximate to the shoulder 14, the windows 20 which are also all on the same circumference being proximate to the end 15 of the housing 2. A latching shoulder 24 is provided in the portion 8 of the cavity 6, towards the left hand (as seen in FIGS. 2 to 5) end 25 of the housing 2.

Figure 2:
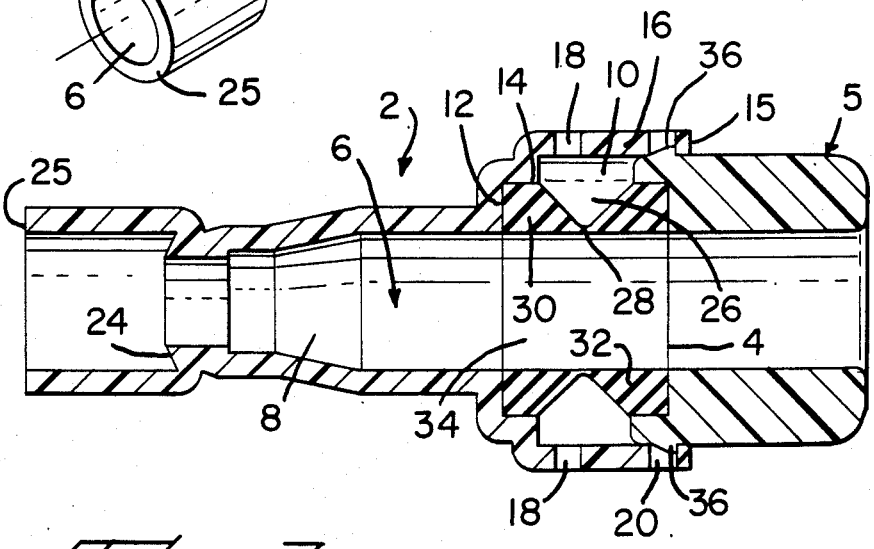
FIG. 2 is an axial sectional view of the assembly.
Figure 4:
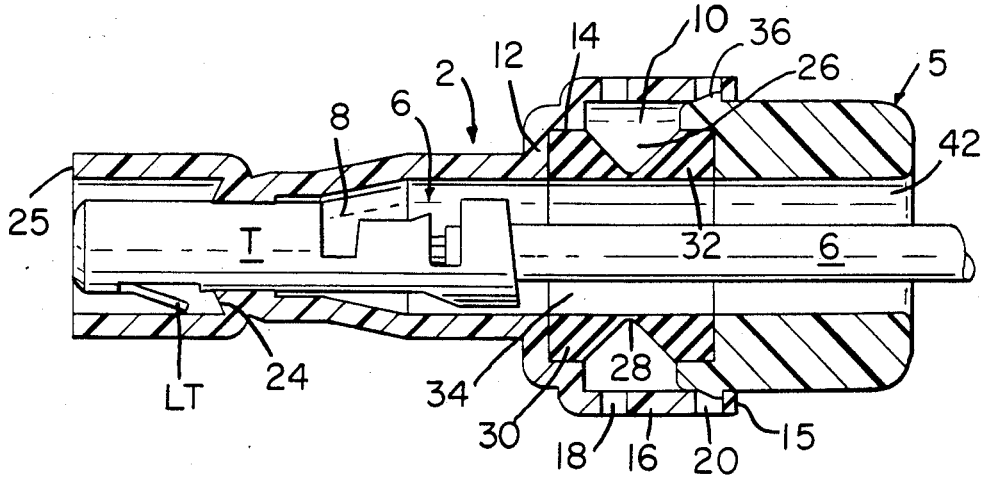
FIG. 4 is a similar view to that of FIG. 2 but showing the terminal after its insertion into the housing.

The sealing ring 4, which is substantially dumbbell shaped as shown in FIG. 1, has an external peripheral recess in the form of a circumferential groove 26 which, as seen in FIGS. 2 and 4 is of substantially V-shaped cross section, being axially central of the ring 4. The depth of the groove 26 is such that the wall of the ring 4, at the base of the groove 26 is very thin, being in the form of a membrane 28 connecting two major portions 30 and 32 of the ring 4. The ring 4 has a circular cross-section bore 34 of constant cross-sectional area.

The cap 5 is of overall circular cylindrical shape is dimensioned so as to be slidable in the cavity portion 10, along the internal wall of the portion 16 of the housing 2. There are formed on the external cylindrical surface of the cap 5, detents in the form of lugs 36, which lie on the same circumference in the vicinity of the left hand (as seen in the drawings) end of the cap 5. The cap 5 is formed with a skirt 38 defining an annular shoulder 40 and has a circular cross-section bore 42, of constant cross-sectional area.

The assembly described above is intended to be loaded with an electrical terminal T which has been crimped to the end of an insulated lead L. The bores 34 and 42 of the ring 4 and of the cap 5, respectively, are both dimensioned so that their cross-sectional areas substantially exceed the maximum cross sectional area of the terminal T and the lead L, to an extent to allow both of these freely to be passed through the bores 34 and 42.

Figure 3:
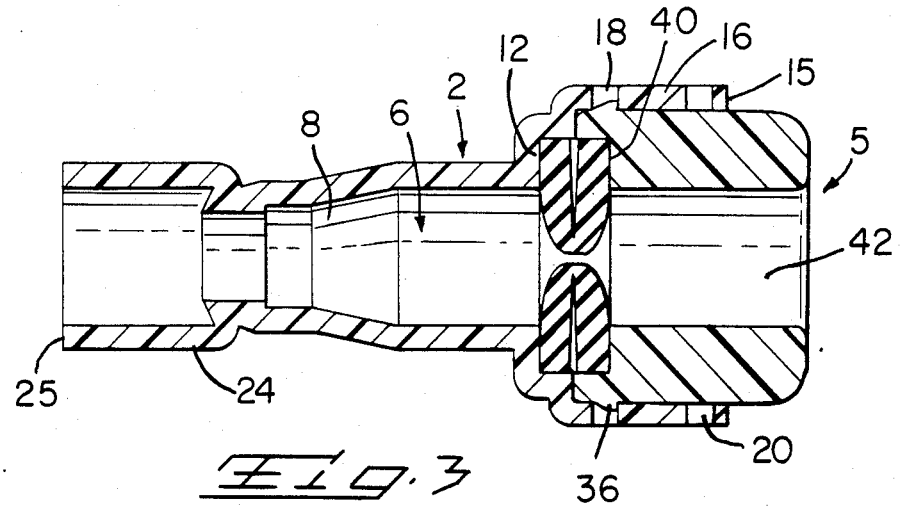
FIG. 3 is a similar view to that of FIG. 2 but showing the cap when it has been driven to a home position in the housing to compress the sealing member.

As shown in FIGS. 2 and 4, the ring 4 is accommodated in the portion 10 of the cavity 6 with its major portion 30 abutting the shoulders 12 and 14. The cap 5 is shown in FIGS. 2 and 4 in a first, outer, position in which it is captive in the portion 10 of the cavity 6 by virtue of the engagement of the lugs 36 in the windows 20 of the wall 16. The lugs 36 are in the form of barbs which prevent retractile movement of the cap 5 from its said outer position, but allow it to be advanced into the portion 10 of the cavity 6 into a second, home, position (FIG. 3) in which the lugs 36 engage in the windows 18 so that the cap 5 is retained in its home position. During its advance from its outer, to its home, position, the cap 5 engages the sealing ring 40 as shown in FIG. 3, so that the major portions 30 and 32 thereof are forced together by compression between the shoulder 40 of the cap 5 and the shoulder 12 of the housing 2, causing the ring 4 to be deformed radially inwardly of the cavity portion 10, the engagement of the lugs 36 in the windows 18 preventing any retractile movement of the cap 5 so that it is secured in its home position.

In order to load the assembly with the terminal T on the lead L, the terminal T is passed freely through the bores 42 and 34 until a locking tongue LT on the terminal T snaps behind the shoulder 24, thereby preventing retraction of the terminal T from the cavity 6. In this position of the terminal T, the lead L extends from the terminal T through both of the bores 34 and 42 and out of the assembly. When the cap 5 is now driven from its outer, to its home, position (FIG. 5) the ring 4 is compressed between the shoulders 12 and 40 as described above with reference to FIG. 3 and is thereby caused to expand radially so as to form a tight seal between the lead L and the housing 2, the shoulder 40 exerting a continuous and permanent compressive force against the seal 4, since the cap 5 cannot be retracted from its second position.

The sealing ring may be formed integrally with the housing, or may be a separate part which is dropped into the cavity in the housing. In the later case, the assembly may be as shown in FIG. 5 in which the sealing ring 4 has chamfered axially outer end faces 50 and 52, which cooperate with complementary inclined faces 54 and 56, of the housing 2' and of the cap 5', respectively, for locating ring 4' in the cavity portion 10'.

The cap may be provided with conventional latching arms (not shown) which extend externally of the housing for engagement with complementary recesses therein, instead of being provided with the lugs 36.

The sealing means described above require no lubrication.

With only minor modifications, the sealing means described above could be applied to a multiway electrical connector.

I claim:

1. An electrical lead sealing assembly comprising:

an insulating housing having a wall defining a cavity for receiving an electrical terminal connected to an end of an electrical lead;

an elastomeric, substantially dumbell shaped, annular sealing member in the cavity, through which member the terminal and the lead can freely be passed so that the lead extends through the sealing member, the sealing member having an external peripheral recess so as to be collapsible under compression in its axial direction;

an annular cap through which the terminal and the lead can also freely be passed, the cap being movable into the housing from an outer position therein into a home position in the housing axially to compress the sealing member thereby to collapse the sealing member to form a seal between the lead and the housing; and means for retaining the cap in its home position, the cap having a skirt surrounding one end of the sealing member, the other end of the sealing member engaging a shoulder in the housing.

2. An assembly as claimed in claim 1, in which the sealing member has chamfered axially outer end faces for cooperation with complementary inclined faces of the housing and of the cap, to locate the sealing member in the housing.

3. An assembly as claimed in claim 1, in which the sealing member is accommodated in an enlarged portion of the cavity, having an open end, the cap having detent lugs engageable in complementary openings provided the wall of said enlarged portion, to retain the cap in its home position, the cap being slidable along an internal wall of said enlarged portion, between said outer and said home positions.

4. An assembly as claimed in claim 3, in which the cap has further detent lugs complementary openings provided in the wall of said enlarged portion to retain the cap in its outer position.

5. An electrical lead sealing assembly comprising in combination:

an elongate insulating housing having a wall defining a through circular cross-section cavity having a first portion opening into one end of the housing and a second portion of greater cross-sectional area than the first portion and opening into the opposite end of the housing;

a shoulder in the housing and being defined by said wall in said second portion of said cavity;

an annular cap disposed in an outer position in said second portion;

an electrical terminal received in the first portion of said cavity;

an insulated electrical lead connected at one end to the terminal;

a substantially dumbell shaped, elastomeric sealing member in the second portion of said cavity, said member having a central V-shaped groove extending about its entire periphery and dividing said member into two major portions connected by a membrane, said member surrounding the lead end and being disposed between said shoulder and said annular cap which also surrounds the lead, both the cap and the sealing member being dimensioned for free passage of the terminal and the lead therethrough, the cap being drivable in sliding engagement with said wall, from said outer position into a home position in said second portion of the cavity so as to compress the sealing member, between the cap and said shoulder, to collapse together said major portions thereof and expand the sealing member, into sealing engagement with the lead and with said wall; and means for retaining said cap non-returnably in said home position, said cap having a skirt surrounding one end of the sealing member, the other end of the sealing member engaging said shoulder in the housing.

* * * * *